US006593852B2

(12) United States Patent
Gutta et al.

(10) Patent No.: US 6,593,852 B2
(45) Date of Patent: Jul. 15, 2003

(54) INTRUDER DETECTION THROUGH TRAJECTORY ANALYSIS IN MONITORING AND SURVEILLANCE SYSTEMS

(75) Inventors: Srinivas Gutta, Buchanan, NY (US); Tomas Brodsky, Croton-on-Hudson, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/194,128

(22) Filed: Jul. 11, 2002

(65) Prior Publication Data

US 2002/0171736 A1 Nov. 21, 2002

Related U.S. Application Data

(63) Continuation of application No. 09/734,821, filed on Dec. 12, 2000, now Pat. No. 6,441,734.

(51) Int. Cl.[7] ..... G08B 13/00

(52) U.S. Cl. ..... 340/541; 348/143; 348/152; 348/155

(58) Field of Search ..... 340/541, 545.1, 340/547, 538; 348/143, 152, 153, 154, 155; 382/118

(56) References Cited

U.S. PATENT DOCUMENTS

| | | | | |
|---|---|---|---|---|
| 4,249,207 A | | 2/1981 | Harman et al. | 348/152 |
| 4,758,823 A | * | 7/1988 | Berruyer et al. | 340/524 |
| 5,657,076 A | | 8/1997 | Tapp | 348/154 |
| 5,831,669 A | | 11/1998 | Adrain | 348/143 |
| 5,966,074 A | * | 10/1999 | Baxter | 340/541 X |
| 5,982,418 A | | 11/1999 | Ely | 348/153 |
| 6,054,928 A | * | 4/2000 | Lemelson et al. | 340/573.4 |
| 6,069,653 A | | 5/2000 | Hudson | 348/143 |
| 6,069,655 A | | 5/2000 | Seeley et al. | 348/154 |
| 6,188,318 B1 | * | 2/2001 | Katz et al. | 340/545.3 |
| 6,441,734 B1 | * | 8/2002 | Gutta et al. | 340/541 |

FOREIGN PATENT DOCUMENTS

| | | |
|---|---|---|
| GB | 2223614 A | 4/1990 |
| GB | 2343945 A | 5/2000 |
| JP | 11-328405 | 11/1999 |

OTHER PUBLICATIONS

Rowley, H.A., et al., "Human Face Detection in Visual Scenes", advances in Neural Information Processing Systems 8, Proceedings of the 1995 Conference, pp. 875–881, 1996.

(List continued on next page.)

*Primary Examiner*—Thomas J Mullen, Jr.
(74) *Attorney, Agent, or Firm*—Gregory L. Thorne

(57) ABSTRACT

A security monitoring system including one or more cameras for monitoring a path of an individual, a recorder for recording the monitoring of the individual, trajectory analyzer for computing a trajectory of the path of the individual from the recorded monitoring, comparator for comparing the trajectory against known trajectories, and an alarm system for transmitting an alarm signal if the trajectory does not match one of the known trajectories. Further, the system may include a database for storing image data for each authorized individual of the structure and a recognition system for comparing images of the individual from the one or more cameras with the stored image data in the database. The alarm system transmits the alarm signal if the trajectory does not match one of the known trajectories and the individual is an authorized individual or if the individual is not an authorized individual.

19 Claims, 2 Drawing Sheets

OTHER PUBLICATIONS

Rowley, H.A., et al., "Rotation Invariant Neural Network–Based Face Detection", Proceedings, 1988 IEEE Computer Society Conference on Computer Vision and Pattern Recognition, pp. 38–44, 1998.

Raja, Y., et al., "Segmentation and Tracking Using Colour Mixture Models", Computer Vision—ACCV '98, Third Asian Conference on Computer Vision, Hong Kong, China, Jan. 1998, Proceedings, vol. 1.

Lee, C.H., et al., "Automatic Human Face Location In A Complex Background Using Motion And Color Information", Pattern Recognition, vol. 29, No. 11, pp. 1887–1889, 1996.

Gutta, S., et al., "Face Surveillance", Sixth International Conference on Computer Vision, The Institute of Electrical and Electronics Engineers, Inc., pp. 646–651.

Stauffer, C., "Automatic hierarchical classification using time–based co–occurrences", IEEE Computer Society Technical Committee on Pattern Analysis and Machine Intelligence, vol. 2, pp. 333–339.

Grimson, W.E.L., et al., "Using adaptive tracking to classify and monitor activities in a site", Proceedings 1988, IEEE Computer Society Conference on Computer Vision and Pattern Recognition, pp. 22–29, 1998.

* cited by examiner

INTRUDER DETECTION THROUGH TRAJECTORY ANALYSIS IN MONITORING AND SURVEILLANCE SYSTEMS

CROSS REFERENCE TO RELATED APPLICATION

This is a continuation of application Ser. No. 09/734,821, filed Dec. 12, 2000, now U.S. Pat. No. 6,441,734.

BACKGROUND OF THE INVENTION

1. Field of the Invention

The present invention relates generally to security monitoring systems and, more particularly, to a security monitoring system that uses trajectories in a way to establish abnormal behavior and triggers an appropriate alarm in response thereto.

2. Prior Art

Security monitoring systems of the prior art, particularly residential security systems, utilize a box that monitors contact sensors for doors and windows and one or more infra-red sensors for area monitoring. When a contact is triggered or an infra-red sensor triggers, an alarm is sounded and a signal is sent via a data link such as a phone line to a central monitoring site. The central monitoring site typically initiates a set of phone calls, to the homeowner, to work, and/or to a designated neighbor to determine if the alarm signal was due to an unauthorized intruder or just to an accidental triggering by a family member or other authorized occupant of the structure.

If the alarm signal cannot be resolved by the phone calls, it is passed to the local police department. 95% of the calls passed to the police department turn out to be "false alarms" in the sense that they were not due to an unauthorized intruder.

SUMMARY OF THE INVENTION

Therefore it is an object of the present invention to provide a security monitoring system which reduces the number of false alarms inherent in the prior art security monitoring systems.

It is a further object of the present invention to provide a security monitoring system that achieves the above objective while reducing the dependency of a central monitoring site to authenticate the validity of an alarm signal.

Accordingly, a security monitoring system is provided. The security monitoring system comprises: at least one camera for monitoring a path of an individual inside and/or outside a structure; a recorder for recording the monitoring of the individual; trajectory analysis means for computing a trajectory of the path of the individual from the recorded monitoring; comparison means for comparing the trajectory against known trajectories; and an alarm system for transmitting an alarm signal based on the comparison. Preferably, the at least one camera comprises a camera for each of an entrance, exit, and one or more rooms of the structure and the at least one camera is a video camera where the recorder records video segments of the path of the individual inside and/or outside the structure. More preferably, the alarm system transmits the alarm signal if the trajectory does not match one of the known trajectories and does not transmit the alarm signal if the trajectory does match one of the known trajectories.

In a preferred implementation of the security monitoring system of the present invention, the system further comprises: a database for storing image data for each authorized individual of the structure; and a recognition system for comparing images of the individual from the at least one camera with the stored image data in the database and for determining if the individual is one of the authorized individuals. The stored image data in the database are preferably face images in which case the recognition system is a face recognition system. In the preferred implementation, the alarm system transmits the alarm signal if the trajectory does not match one of the known trajectories and the individual is determined not to be one of the authorized individuals and does not transmit the alarm signal if the trajectory does match one of the known trajectories or the individual is determined to be one of the authorized individuals.

Also provided is a method for monitoring a structure. The method comprises the steps of: monitoring a path of an individual inside and/or outside the structure; recording the monitoring of the individual; computing a trajectory of the path of the individual from the monitoring; comparing the trajectory against known trajectories; and determining whether to transmit an alarm signal based on the comparison. The computing step preferably comprises computing the trajectory of the individual based on spatial and/or timing information derived from the monitoring. More preferably, the determining step comprises transmitting the alarm signal if the trajectory does not match one of the known trajectories and not transmitting the alarm signal if the trajectory does match one of the known trajectories.

In a preferred implementation of the method of the present invention, the method further comprises the steps of: storing image data for each authorized individual of the structure; and comparing images of the individual from the at least one camera with the stored image data in the database and for determining if the individual is one of the authorized individuals. In the preferred implementation, the determining step comprises transmitting the alarm signal if the trajectory does not match one of the known trajectories and the individual is determined not to be one of the authorized individuals and not transmitting the alarm signal if the trajectory does match one of the known trajectories or the individual is determined to be one of the authorized individuals.

In a yet more preferred implementation of the methods of the present invention, if the determining step determines that the trajectory does not match one of the known trajectories and the individual is determined to be one of the authorized individuals, the method further comprises the step of adding the trajectory to the known trajectories.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of security monitoring systems, it has been found particularly useful in the environment of residential security monitoring systems. Therefore, without limiting the applicability of the invention to residential security monitoring systems, the invention will be described in such environment.

The present invention is a security monitoring system and methods for using the same that uses trajectories in a way to establish abnormal behavior and triggers an appropriate alarm by monitoring the entrance, exit, and/or other rooms of a structure; recording key video segments; tracking an unknown individual in the structure thereby producing trajectories; and performing a trajectory analysis. Although the unknown individual may turn out to be an authorized individual, he or she is referred to as an unknown individual until classified as either authorized or unauthorized. If an abnormal trajectory is found, the system can trigger an alarm signal, or alternatively, check whether the unknown individual is authorized to be in the structure before triggering the alarm signal. "Trajectory" as used in the present invention describes the path of an unknown individual within one or multiple rooms of a structure, and/or possibly outside of the structure. It can include not only spatial information (where the person went) but also timing information (speed of motion, whether the unknown individual stopped at a certain spot and for how long, etc.). The system of the present invention is based on the notion that each individual exhibits certain characteristics as they perform activities in a structure. This is particularly true for members of a residential household. For instance, when an individual enters a house, he or she might first go to check the mail, open the refrigerator, switch on the television, etc. These are activities that an unauthorized intruder is unlikely to perform.

A trajectory is said to be "abnormal" if it does not match a known trajectory in a database of acceptable trajectories for each authorized individual in the structure. It is assumed that such a database has been built prior to the use of the system. However, as will be discussed below, the system of the present invention can also build the database of known trajectories as it is used with the utilization of a recognition system, such as face recognition.

Figure 1:
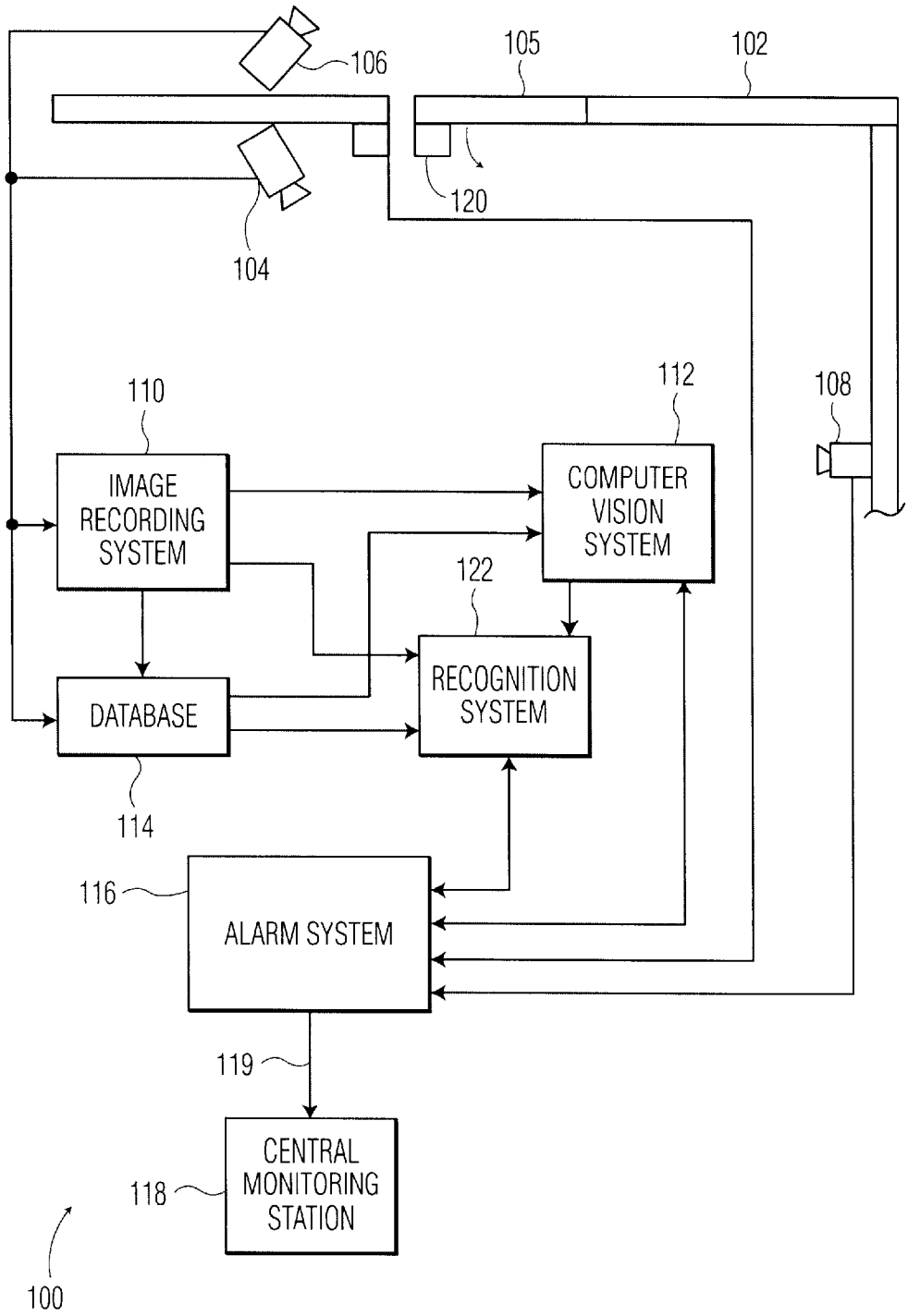
FIG. 1 illustrates a schematical view of a structure having the security monitoring system of the present invention.

Referring now to FIG. 1, there is illustrated a preferred implementation of the security monitoring system of the present invention, generally referred to by reference numeral 100. The security monitoring system 100 comprises at least one camera for monitoring a path of an unknown individual inside and/or outside a structure 102. Preferably, the security monitoring system 100 comprises several cameras including an exit and entrance camera 104, 106 and a room camera 108. Although, FIG. 1 illustrates only a single room camera 108, it is illustrated as such to generally describe the system and methods of the present invention. Preferably, a room camera 108 is provided in each of several rooms and more preferably, in each room of the structure 102. The exit, entrance, and room cameras are preferably color video cameras. Furthermore, the exit, entrance, and/or room cameras 104, 106, 108 can be static or pan-tilt-zoom (PTZ) type. The exit and entrance cameras 104, 106 are shown mounted near the door 105 and facing towards the exit and entrance 104*a*, 106*a*, respectively. However, this configuration is illustrated for its simplicity. Preferably, the exit and entrance cameras 104, 106 are mounted in a door 105 as is described in co-pending U.S. patent application Ser. No. 09/734,780 which is incorporated herein by its reference.

The system 100 of the present invention also comprises an image recording system 110 (alternatively referred to as a recorder) for recording the monitoring of the individual. Preferably, the recorder 110 records the monitored path. Preferably, the entire video sequence is recorded as long as the unknown individual is in the camera's field of view. It is preferred that the image recording system 110 is preferably a computer or other processor having a storage device such as a hard drive and an image capture card. However, those skilled in the art will recognize that the image recording system 110 can be of any type known in the art without departing from the scope and spirit of the present invention.

A trajectory analysis means, such as a computer vision system 112, computes a trajectory of the path of the unknown individual from the recorded monitoring. The computed trajectory is then compared against known trajectories in a database 114. The known trajectories in the database 114 are preferably associated with each authorized individual of the structure. If there is no match between a computed trajectory and a known trajectory in the database 114, an alarm system 116 triggers an alarm signal and preferably transmits the same to a central monitoring site 118 via a data link 119, such as a telephone line (POTS). Such computer vision systems 112 are well known in the art, such as that described in Grimson et al., "Using Adaptive Tracking to Classify and Monitor Activities in a Site," IEEE Conference on Computer Vision and Pattern Recognition, Santa Barbara, Calif., Jun. 23–25, 1998. However, those skilled in the art will recognize that the computer vision system 112 can be of any type known in the art without departing from the scope and spirit of the present invention, such as that described in Stauffer, "Automatic hierarchical classification using time-based co-occurrences," IEEE Conference on Computer Vision and Pattern Recognition, Vol. II, pp. 333–339, Fort Collins, Colo., Jun. 23–25, 1999.

The alarm system 116 can be a typical alarm system known in the art having magnetic door contact sensors 120 and/or infrared detectors (not shown) which is additionally capable of receiving and processing information from the computer vision system 112. The security monitoring system may include conventional detectors of the alarm system 116 as shown in FIG. 1. However, those skilled in the art will realize that the alarm system does not need to include such conventional detectors but can rely solely upon the trajectory analysis performed by the computer vision system 112 in determining whether to trigger an alarm signal.

Alternatively, the security monitoring system 100 further comprises a database for storing image data for each authorized individual of the structure, such as face image data. In the case of a residential home, the faces of the people living in the home are recorded, preferably by the exit and/or entry cameras 104, 106 and stored in the database 114. Although a separate database can be utilized for both the known trajectories and face image data, FIG. 1 illustrates a single database 114 for both. Where the computer vision system 112 determines that a computed trajectory is not one of the known trajectories in the database 114, instead of triggering an alarm, the security monitoring system 100 can alternatively utilize the recognition system 122 which compares the images of the unknown individual from one of the cameras 104, 106, 108 with the stored image data (e.g., faces) of the authorized individuals in the database 114 to determine if the unknown individual is one of the authorized individuals. If there is no match between the stored images of the unknown individual with the stored image data of the authorized individuals in the database 114 then the system 100 proceeds as described above by triggering an alarm signal to the central monitoring site 118. Face recognition algorithms and systems are well known in the art, such as the one described by S. Gutta et al., *Face Recognition,* Sixth International Conference on Computer Vision, pgs. 646–651, IEEE, Jan. 4–7 1998, Mumbai, India.

If either the comparison of the computed and known trajectories from the computer vision system 112 or the comparison of the stored images of the unknown individual with the stored image data of the authorized individuals in the database 114 results in a match, the alarm signal is not triggered. In the situation where the computed trajectory does not match one of the known trajectories in the database 114 but the face of the unknown individual matches one of the faces of an authorized individual, the computed trajectory is added to the known trajectories for that individual.

Figure 2:
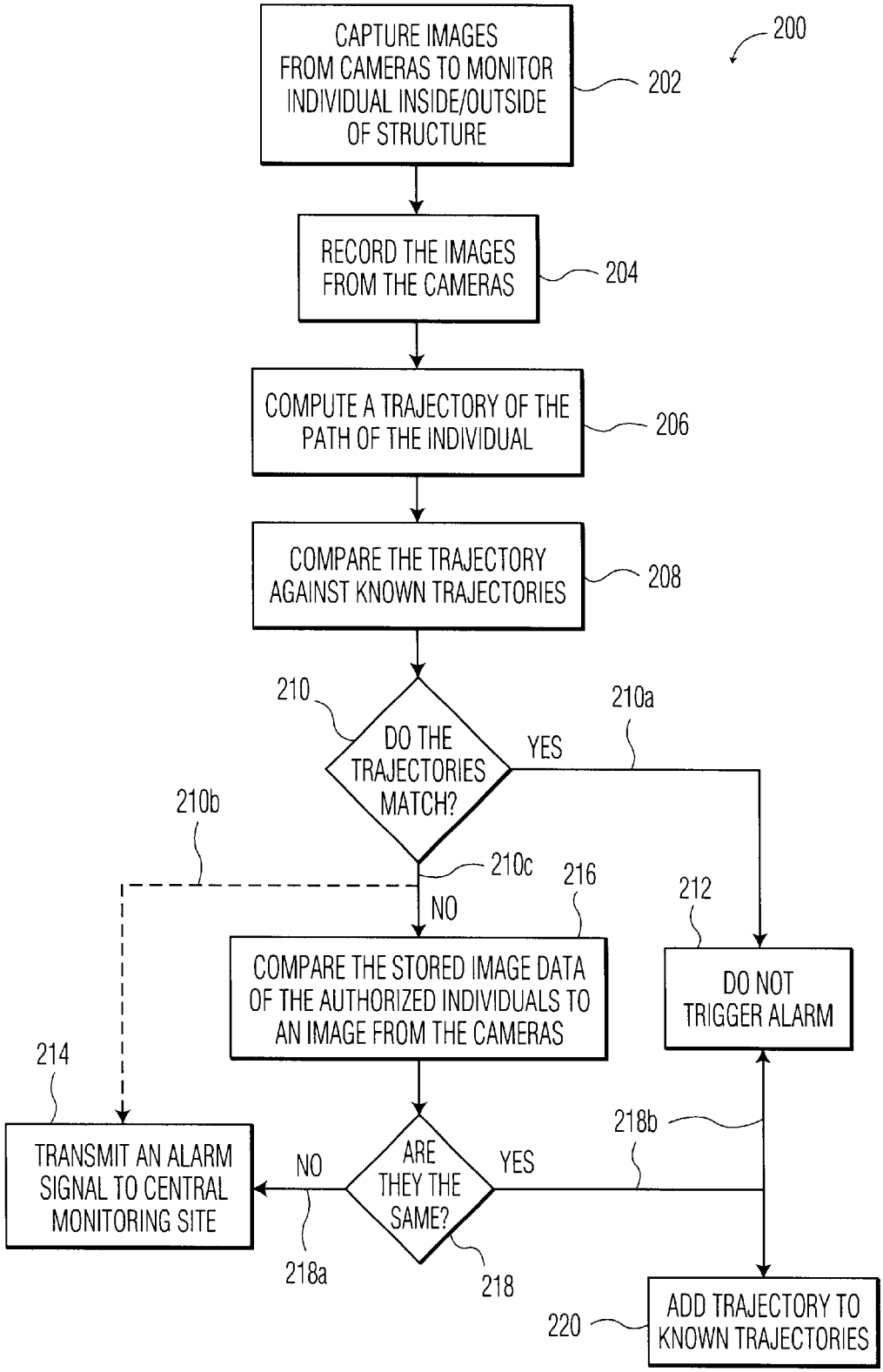
FIG. 2 illustrates a flow chart of a preferred implementation of a method for monitoring the structure of FIG. 1.

A preferred method for practicing the present invention will be described with reference to the flowchart of FIG. 2, the method being generally referred to by reference numeral 200. At step 202, image data, generally in the form of color video image data is captured by interior and/or exterior cameras 104, 106, 108 to monitor a path of an unknown individual inside and/or outside the structure 102. At step 204, the monitored path of the unknown individual is recorded in the image recording system 110. At step 206, the computer vision system 112 analyzes the recorded image data and computes a trajectory of the path of the unknown individual. At step 208, the computed trajectory is compared against the known trajectories in the database 114.

At step 210, it is determined whether or not the computed trajectory matches one of the known trajectories. If there is a match between the computed trajectory and one of the known trajectories, the method proceeds along path 210*a* to step 212 where the alarm system 116 does not trigger an alarm. In other words, the detection of the unknown individual does not trigger an alarm because his trajectory matches one of the known trajectories making him likely to have authorization to be in the structure. If the computed trajectory does not match one of the known trajectories, then the method can proceed along path 210*b* (shown as a dotted line) to step where the alarm system 116 triggers an alarm and preferably transmit that alarm signal to a central monitoring site 118 along a data link 119.

At step 218, it is determined if the unknown individual is one of the authorized individuals. In other words, it is determined if there is a match between the captured images of the unknown individual and the stored images of the authorized individuals. If there is not a match, the method proceeds along path 218*a* to step 214, where an alarm signal is triggered by the alarm system 116. However, if there is a match between the unknown individual and the image data of the authorized individuals, even though the unknown individual's trajectory did not match one of the known trajectories, the method proceeds along path 218*b* to step 212 where it is determined not to trigger an alarm signal. In this situation, the method preferably also adds the computed trajectory to the known trajectories for the recognized individual at step 220. Thus, in this way, the system can build an acceptable database of known trajectories while it is being used and can also account for changes in habit or circumstance by any of the authorized individuals. For instance, furniture can be moved making for a different path to the refrigerator, or an authorized individual may become permanently or temporarily disabled and his or her path may become more efficient.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A security monitoring system comprising:

at least one camera for monitoring a path of an individual inside and/or outside a structure;

a recorder for recording the monitoring of the individual;

trajectory analysis means for computing a trajectory of the path of the individual from the recorded monitoring;

comparison means for comparing the trajectory against a stored database of known trajectories; and an alarm system for transmitting an alarm signal based on the comparison.

2. The security monitoring system of claim 1, wherein the at least one camera comprises a camera for each of an entrance, exit, and one or more rooms of the structure.

3. The security monitoring system of claim 1, wherein the at least one camera is a video camera and the recorder records video segments of the path of the individual inside and/or outside the structure.

4. The security monitoring system of claim 1, wherein the trajectory analysis means is a computer vision system.

5. The security monitoring system of claim 1, wherein the trajectory analysis means computes the trajectory of the individual based on spatial and/or timing information derived from the monitoring.

6. The security monitoring system of claim 1, wherein the alarm system transmits the alarm signal if the trajectory does not match one of the known trajectories.

7. The security monitoring system of claim 1, wherein the alarm system does not transmit the alarm signal if the trajectory does match one of the known trajectories.

8. The security monitoring system of claim 1, further comprising:

a database for storing image data for each authorized individual of the structure; and a recognition system for comparing images of the individual from the at least one camera with the stored image data in the database and for determining if the individual is one of the authorized individuals.

9. The security monitoring system of claim 8, wherein the stored image data in the database are face images and the recognition system is a face recognition system.

10. The security monitoring system of claim 8, wherein the alarm system transmits the alarm signal if the trajectory does not match one of the known trajectories and the individual is determined not to be one of the authorized individuals.

11. The security monitoring system of claim 8, wherein the alarm system does not transmit the alarm signal if the trajectory does match one of the known trajectories or the individual is determined to be one of the authorized individuals.

12. A method for monitoring a structure, the method comprising the steps of:

monitoring a path of an individual inside and/or outside the structure;

recording the monitoring of the individual;

computing a trajectory of the path of the individual from the monitoring;

comparing the trajectory against a stored database of known trajectories; and determining whether to transmit an alarm signal based on the comparison.

13. The method of claim 12, wherein computing step comprises computing the trajectory of the individual based on spatial and/or timing information derived from the monitoring.

14. The method of claim 12, wherein the determining step comprises transmitting the alarm signal if the trajectory does not match one of the known trajectories.

15. The method of claim 12, wherein the determining step comprises not transmitting the alarm signal if the trajectory does match one of the known trajectories.

16. The method of claim 12, further comprising the steps of:

storing image data for each authorized individual of the structure; and comparing images of the individual from at least one camera with the stored image data in a database and determining if the individual is one of the authorized individuals.

17. The method of claim 16, wherein the determining step comprises transmitting the alarm signal if the trajectory does not match one of the known trajectories and the individual is determined not to be one of the authorized individuals.

18. The method of claim 16, wherein the determining step comprises not transmitting the alarm signal if the trajectory does match one of the known trajectories or the individual is determined to be one of the authorized individuals.

19. The method of claim 16, wherein if the determining step determines that the trajectory does not match one of the known trajectories and the individual is determined to be one of the authorized individuals, the method further comprises the step of adding the trajectory to the known trajectories.

* * * * *